US012379167B2

(12) United States Patent
Barus et al.

(10) Patent No.: US 12,379,167 B2
(45) Date of Patent: Aug. 5, 2025

(54) HEADER TANK ASSEMBLY

(71) Applicant: Valeo Autosystemy Sp. z o.o., Skawina (PL)

(72) Inventors: Lukasz Barus, Skawina (PL); Radoslaw Godzina, Skawina (PL); Mateusz Nawrocki, Skawina (PL)

(73) Assignee: Valeo Autosystemy Sp. z o.o., Skawina (PL)

( * ) Notice: Subject to any disclaimer, the term of this patent is extended or adjusted under 35 U.S.C. 154(b) by 0 days.

(21) Appl. No.: 17/769,090

(22) PCT Filed: Oct. 15, 2020

(86) PCT No.: PCT/EP2020/079053

§ 371 (c)(1),
(2) Date: Apr. 14, 2022

(87) PCT Pub. No.: WO2021/074300

PCT Pub. Date: Apr. 22, 2021

(65) Prior Publication Data

US 2024/0102746 A1 Mar. 28, 2024

(30) Foreign Application Priority Data

Oct. 18, 2019 (EP) ..... 19461589

(51) Int. Cl.
*F28F 9/02* (2006.01)
*F28F 9/16* (2006.01)

(52) U.S. Cl.
CPC ..... *F28F 9/0226* (2013.01); *F28F 9/165* (2013.01); *F28F 2275/122* (2013.01)

(58) Field of Classification Search
CPC ..... F28F 9/165; F28F 9/0226; F28F 2275/122
See application file for complete search history.

(56) References Cited

U.S. PATENT DOCUMENTS 5,979,546 A 11/1999 Stolarski et al.
7,156,401 B2 * 1/2007 Merklein ..... F28F 9/0226 165/149

(Continued)

FOREIGN PATENT DOCUMENTS

CN 102762947 A 10/2012
CN 106917667 A 7/2017

(Continued)

OTHER PUBLICATIONS

International Search Report and Written Opinion in corresponding International Application No. PCT/EP2020/079053, mailed Feb. 3, 2021 (8 pages).

(Continued)

*Primary Examiner* — Paul Alvare
(74) *Attorney, Agent, or Firm* — Osha Bergman Watanabe & Burton LLP

(57) ABSTRACT

A header-tank assembly (100*a*) includes a tank (10*a*), a gasket (20*a*) and a header (30*a*). The tank (10*a*) includes a plurality of first engagement elements (12*a*) configured thereon. The gasket (20*a*) includes a plurality of second engagement elements (22*a*) configured thereon. The second engagement elements (22*a*) are complimentary to and engages with the first engagement elements (12*a*) to mount the gasket (20*a*) along a periphery of a foot portion (14*a*) of the tank. The header (30*a*) is crimped to the foot portion (14*a*) of the tank (10*a*) with the gasket (20*a*) disposed between the header (30*a*) and the foot portion (14*a*) of the tank (10*a*).

8 Claims, 8 Drawing Sheets

(56) References Cited

U.S. PATENT DOCUMENTS

| | | | | |
|---|---|---|---|---|
| 2002/0162648 | A1* | 11/2002 | Crook | F02B 29/0456 165/173 |
| 2009/0255657 | A1* | 10/2009 | Hakamata | B23P 15/26 165/173 |
| 2017/0010059 | A1* | 1/2017 | Abell | F28F 9/0268 |
| 2017/0016684 | A1* | 1/2017 | Okubo | F28F 1/045 |
| 2017/0115069 | A1* | 4/2017 | Ferrand | F28F 9/0263 |
| 2020/0166297 | A1* | 5/2020 | DeLugan | F28D 1/0233 |

FOREIGN PATENT DOCUMENTS

| | | | | | |
|---|---|---|---|---|---|
| CN | 110017704 | A | | 7/2019 | |
| CN | 111094887 | A | | 5/2020 | |
| DE | 2005283 | A1 | | 9/1970 | |
| DE | 2353405 | A | * | 4/1975 | B60H 1/00328 |
| DE | 2353419 | A | * | 4/1975 | F28D 1/05325 |
| DE | 2932249 | A1 | | 3/1980 | |
| DE | 3833262 | A1 | | 4/1990 | |
| DE | 4243495 | A1 | * | 6/1994 | F16J 15/061 |
| DE | 29704913 | U1 | | 7/1998 | |
| DE | 10213064 | A1 | * | 11/2004 | B60H 1/00521 |
| DE | 102005054712 | A1 | * | 6/2007 | F16J 15/061 |
| DE | 102008018594 | A1 | * | 10/2008 | F02B 29/0462 |
| FR | 2624595 | A | * | 6/1989 | F28F 9/0226 |
| FR | 2624595 | A1 | * | 6/1989 | |
| FR | 3056737 | A1 | * | 3/2018 | F28F 21/06 |
| WO | 2017/069280 | A1 | | 4/2017 | |

OTHER PUBLICATIONS

Office Action issued in counterpart Chinese Patent Application No. CN 202080066774.8 mailed Dec. 22, 2023 (16 pages).

1 Office Action in corresponding Chinese Application No. 202080066774.8, dated Jul. 10, 2024 (7 pages).

* cited by examiner

HEADER TANK ASSEMBLY

The present invention relates to a heat exchanger, more particularly, the present invention relates to a header-tank assembly for the heat exchanger.

Figure 1A:
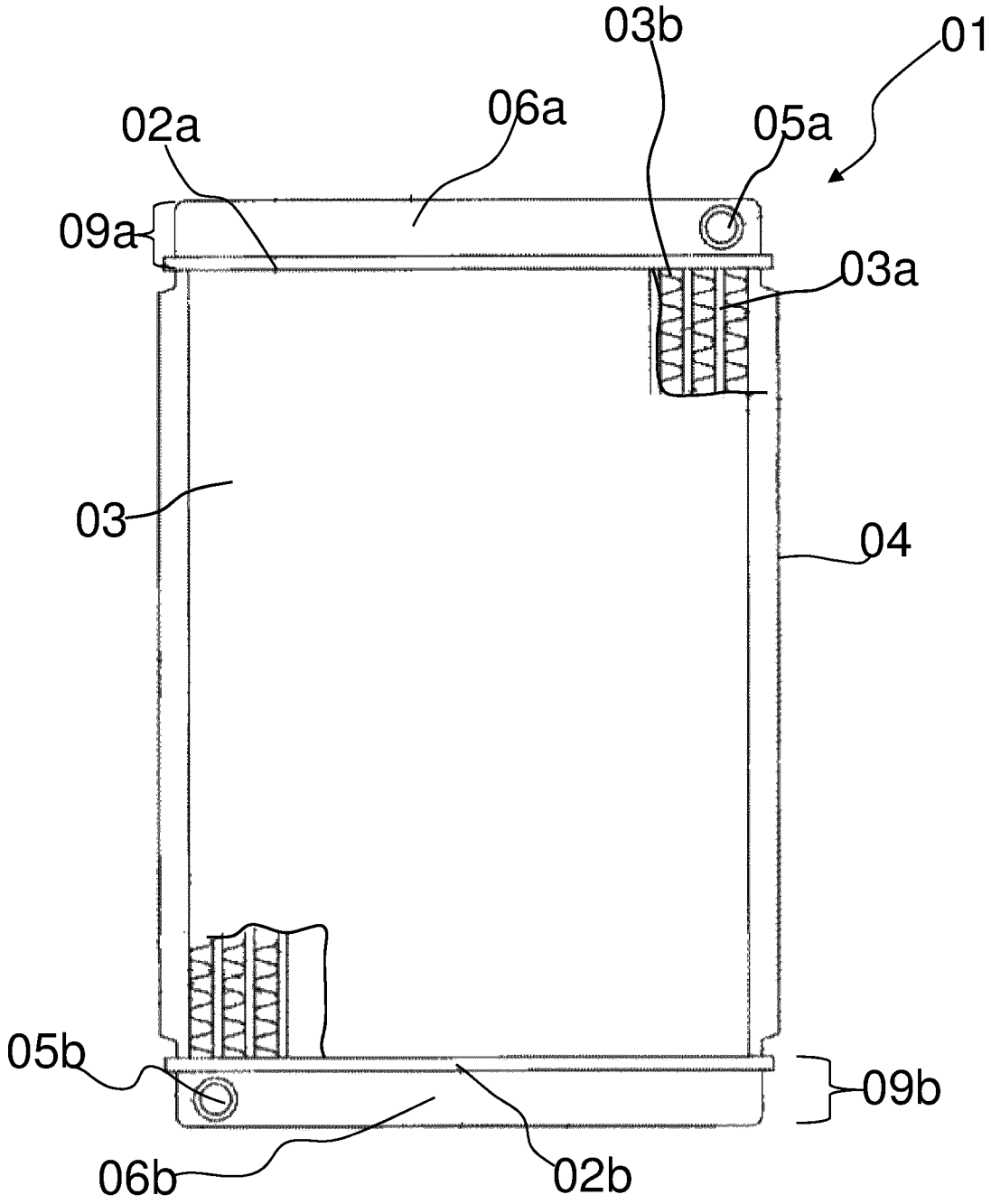
FIG. 1a (PRIOR ART)
Figure 1B:
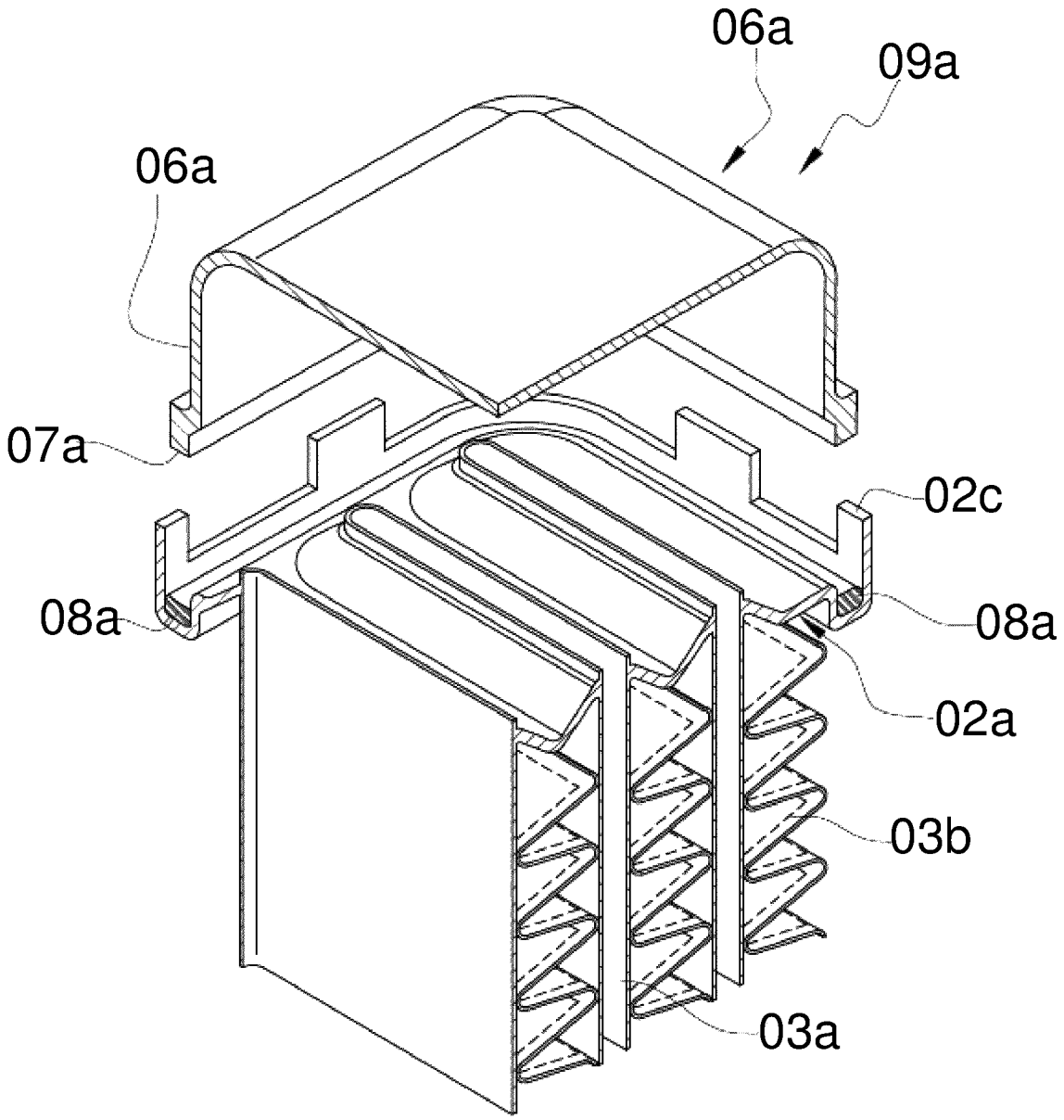
FIG. 1b (PRIOR ART)
Figure 1C:
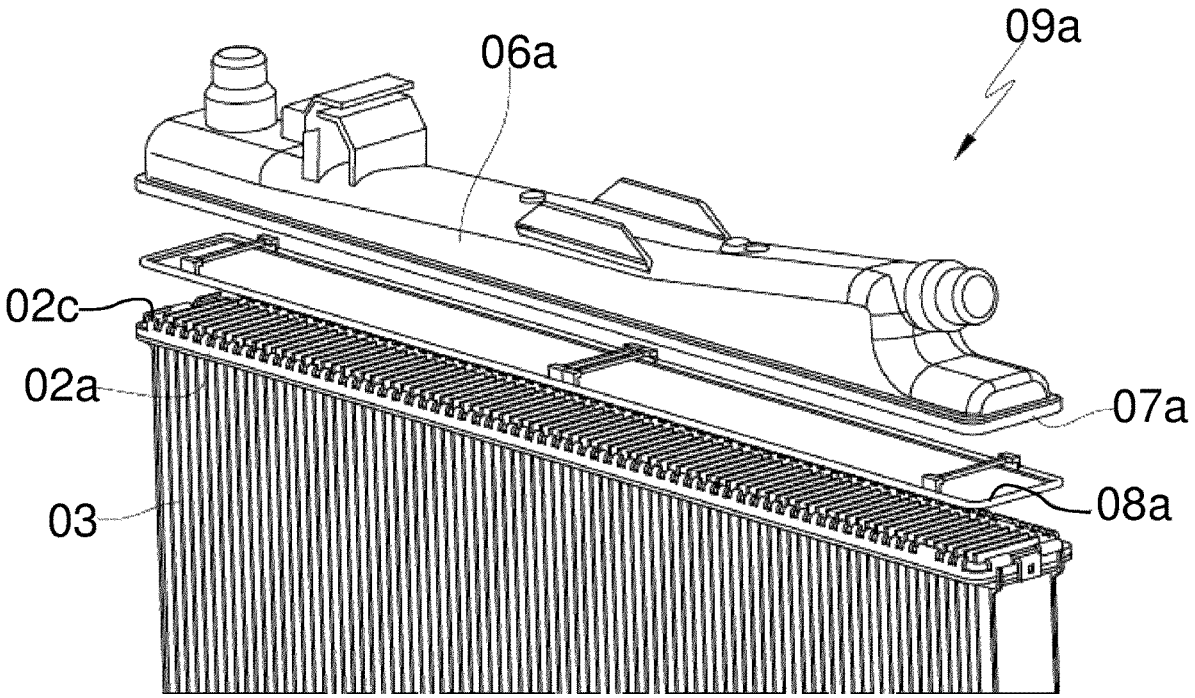
FIG. 1c (PRIOR ART)

Referring to FIG. 1*a*-FIG. 1*c* of the accompanying drawings, a prior art heat exchanger such as for example a heat exchanger 01 used in a vehicle includes a pair of spaced apart headers 02*a* and 02*b* connected to two distant and opposite end portions of a heat exchanger core 03. The heat exchanger core 03 is configured of a plurality of heat exchange elements, particularly, heat exchange tubes 03*a* through which a first heat exchange fluid flows and a plurality of fin elements 03*b* lodged between the adjacent heat exchange tubes 03*a*. More specifically, the heat exchanger 01 is a radiator, and a fan system directs air over the heat exchanger core 03. Such configuration facilitates heat exchange between the first heat exchanging fluid flowing inside the heat exchange tubes 03*a* and air flowing outside the heat exchange tubes 03*a*.

The heat exchanger 01 further includes a pair of heat exchanger tanks 06*a* and 06*b*, hereinafter referred to as tanks corresponding to the pair of headers 02*a*, 02*b*, wherein crimping connection is formed between the tanks 06*a*, 06*b* and the corresponding headers 02*a*, 02*b* for configuring a header-tank assembly 09*a*, 09*b*. The tanks 06*a*, 06*b* are capable of receiving first heat exchanging fluid, often, pressurized heat exchanging fluid and the tanks 06*a*, 06*b* in conjunction with the corresponding headers 02*a*, 02*b* facilitate distribution of the first heat exchange fluid to and collection of the first heat exchange fluid from the heat exchange tubes of the heat exchange core 03 respectively. Particularly, the first heat exchange fluid ingresses the tank 06*a* via an inlet 5*a*, passes through the heat exchange tubes 03*a*, reaches the tank 06*b* and egresses out of the tank 06*b* via an outlet 05*b*. In case the first heat exchange fluid leaks through the connection between the headers 02*a*, 02*b* and the corresponding tanks 06*a*, 06*b*, the efficiency and performance of the heat exchanger 01 is detrimentally impacted. According, an airtight and sealed connection is required between the tanks 06*a*, 06*b* and the corresponding headers 02*a*, 02*b*.

To achieve sealed connection between the tank 06*a*, 06*b* and the corresponding header 02*a*, 02*b*, a gasket is disposed between the tank 06*a*, 06*b* and the corresponding header 02, 02*b*. Specifically, the conventional header-tank assembly 09*a*, 09*b* and assembly process therefor involves receiving the gasket 08 in the header 02*a*, 02*b*. Thereafter, configuring crimping connection between the header 02*a*, 02*b* and the corresponding tank 06*a*, 06*b*. Particularly, tabs 02*c*, 02*d* configured on the headers 02*a*, 02*b* are folded over foot portions 07*a*, 07*b* of the respective tanks 06*a*, 06*b* to configure crimping connection between the headers 02*a*, 02*b* and the corresponding tanks 06*a*, 06*b* with the gasket 08*a*, 08*b* disposed there between. However, during crimping, displacing and compressive forces exerted on the gasket 08*a*, 08*b* may cause displacement of the gasket 08*a*, 08*b* from a desired position thereof between the foot portion of the tanks 06*a*, 06*b* and the corresponding header 02*a*, 02*b* and pinching of the gasket 08*a*, 08*b* is common. Further, the gasket 08*a*, 08*b* is generally of improper size and is required to be adjusted depending upon size of the tank 06*a*, 06*b* and the corresponding header 02*a*, 02*b* to prevent pinching of the gasket 08. Accordingly, in case of the conventional header-tank assembly 09*a*, 09*b* and the assembly process there for, there are comparatively higher chances of pinching of the gasket 08*a*, 08*b*. The pinching of the gasket 08*a*, 08*b* have several drawbacks, for example, the pinching of the gasket 08*a*, 08*b* may cause damage to the gasket 08*a*, 08*b* and leakage may occur through the damaged gasket, thereby adversely impacting efficiency and performance of the heat exchanger 01. Further, conventional header-tank assembly 01 and the assembly process therefor requires more number of assembly steps and is complicated.

Accordingly, there is a need for a header-tank assembly and assembly process therefor that prevents pinching of a gasket between a tank and a corresponding header thereof by eliminating the chances of displacement of the gasket during crimping or assembly of the tank over the header or due to selection of improper sized gasket. Further, there is a need for a header-tank assembly and assembly process therefor that prevents pinching of the gasket and as such all drawbacks associated with pinching of the gasket. Specifically, there is a need for a header-tank assembly that addresses issues such as damage to the gasket, reduced service life and reliability issues associated with the gasket due to pinching of the gasket, in-efficient operation and performance of the heat exchanger due to leakage of heat exchange fluid through the damaged gasket. Furthermore, there is a need for a header-tank assembly and an assembly process therefor that reduces the assembly steps and assembly time involved in assembling of a tank over a corresponding header of a heat exchanger, with a gasket disposed between a foot portion of the tank and the header.

An object of the present invention is to provide a header-tank assembly and assembly process therefor that prevents pinching of a gasket due to displacement of the gasket during assembly or selection of improper sized gasket, thereby preventing drawbacks associated with the pinching of the gasket.

Another object of the present invention is to provide a header-tank assembly and assembly process therefor that provides ease of assembly, reduces assembly time and number of assembly steps.

Yet another object of the present invention is to provide a header-tank assembly that configures secure sealed connection between a tank and the corresponding header, thereby improving efficiency and performance of the heat exchanger by preventing leakage of heat exchange fluid through connection between header and the corresponding tank.

Still another object of the present invention is to provide a header-tank assembly that enhances service life and reliability of gasket, thereby improving service life and reliability of the heat exchanger.

Yet another object of the present invention is to provide a header-tank assembly that involves fewer parts and accordingly is inexpensive, reliable, and convenient to assembly.

In the present description, some elements or parameters may be indexed, such as a first element and a second element. In this case, unless stated otherwise, this indexation is only meant to differentiate and name elements which are similar but not identical. No idea of priority should be inferred from such indexation, as these terms may be switched without betraying the invention. Additionally, this indexation does not imply any order in mounting or use of the elements of the invention.

A header-tank assembly is disclosed in accordance with an embodiment of the present invention. The header-tank assembly includes a tank, a gasket and a header. The tank includes a plurality of first engagement elements configured thereon. The gasket includes a plurality of second engagement elements configured thereon. The second engagement elements are complimentary to and engages with the first engagement elements to mount the gasket along a periphery of a foot portion of the tank. The header is crimped to the foot portion of the tank with the gasket disposed between the header and the foot portion of the tank.

In accordance with a preferred embodiment of the present invention, the second engagement elements are formed on connection elements outwardly extending from the gasket.

Specifically, the connection elements are configured at corners of the gasket and do not interfere with crimping of the header over the foot portion of the tank while configuring connection between the first and the second engagement elements.

Particularly, the connection elements and the second engagement elements formed on the connection elements are integrally formed with the gasket and are configured of same material as that of the gasket.

Generally, the connection elements are having cross-sectional dimension less than that of the gasket.

Particularly, the first engagement elements and the corresponding complimentary second engagement elements are selected from a group comprising snap fit engagement elements, loop-rod type engagement elements and the likes.

In accordance with an embodiment of the present invention, the tank further includes cut-out portions configured at corners thereof for guiding the connection elements such that the second engagement elements configured on the connection element are guided to the first engagement elements.

A heat exchanger tank is disclosed in accordance with an embodiment of the present invention. The heat exchanger tank includes a plurality of first engagement elements that engages with a plurality of second engagement elements configured on a gasket to mount the gasket along periphery of a foot portion of the heat exchanger tank.

Generally, the first engagement elements are located substantially on opposite sides of the tank with respect to the gasket and the header.

In accordance with an embodiment of the present invention, the first engagement elements are located substantially on a side of the tank that is adjacent to and orthogonal to a side accommodating the gasket and the header.

Specifically, the connection between the first engagement elements and the corresponding complimentary second engagement elements is releasable engagement.

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein:

FIG. 1*a* illustrates a schematic representation of a heat exchanger in accordance with a prior art;

FIG. 1*b* illustrates an exploded sectional view of a conventional header-tank assembly of the heat exchanger of FIG. 1*a;*

FIG. 1*c* illustrates another exploded view of the conventional header-tank assembly of FIG. 1*b;*

Figure 2A:
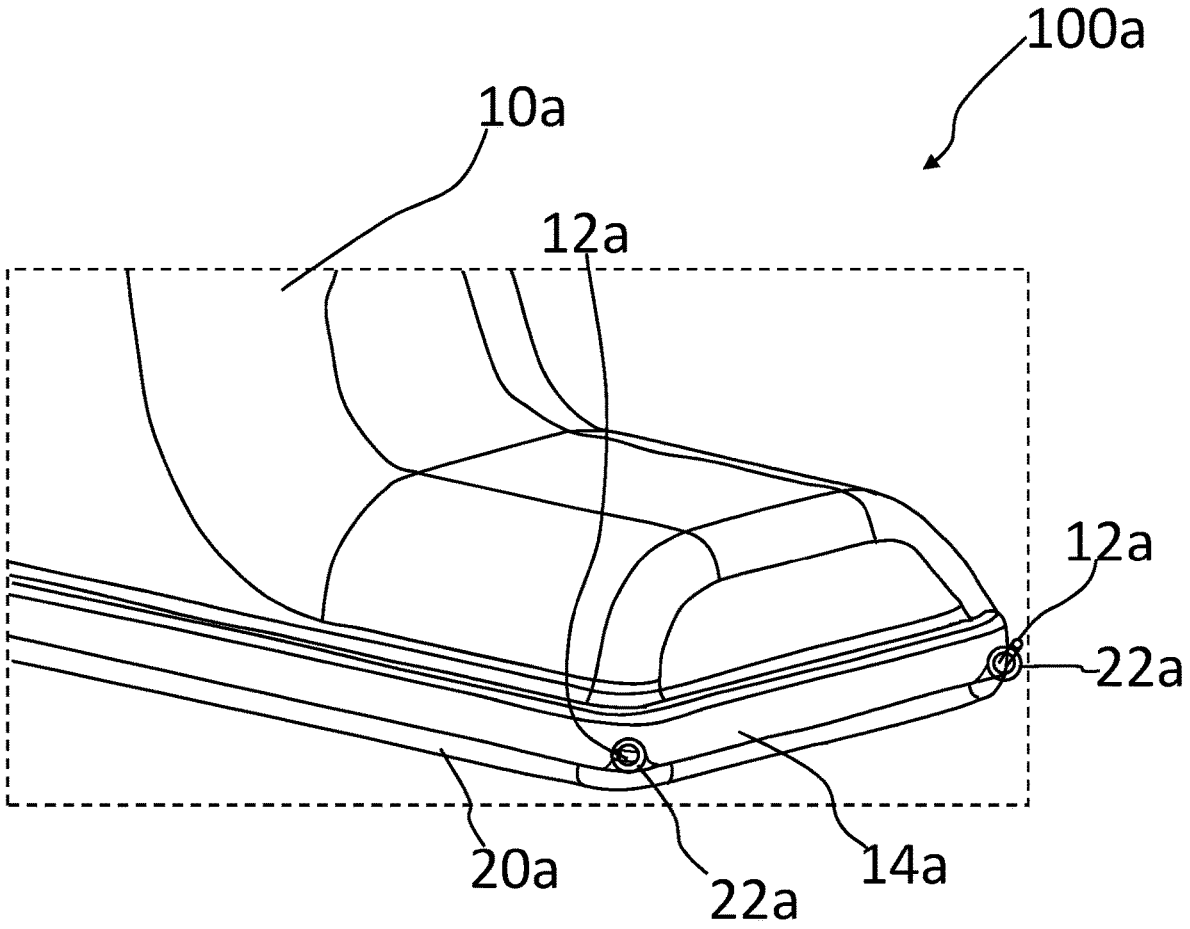
Figure 2B:
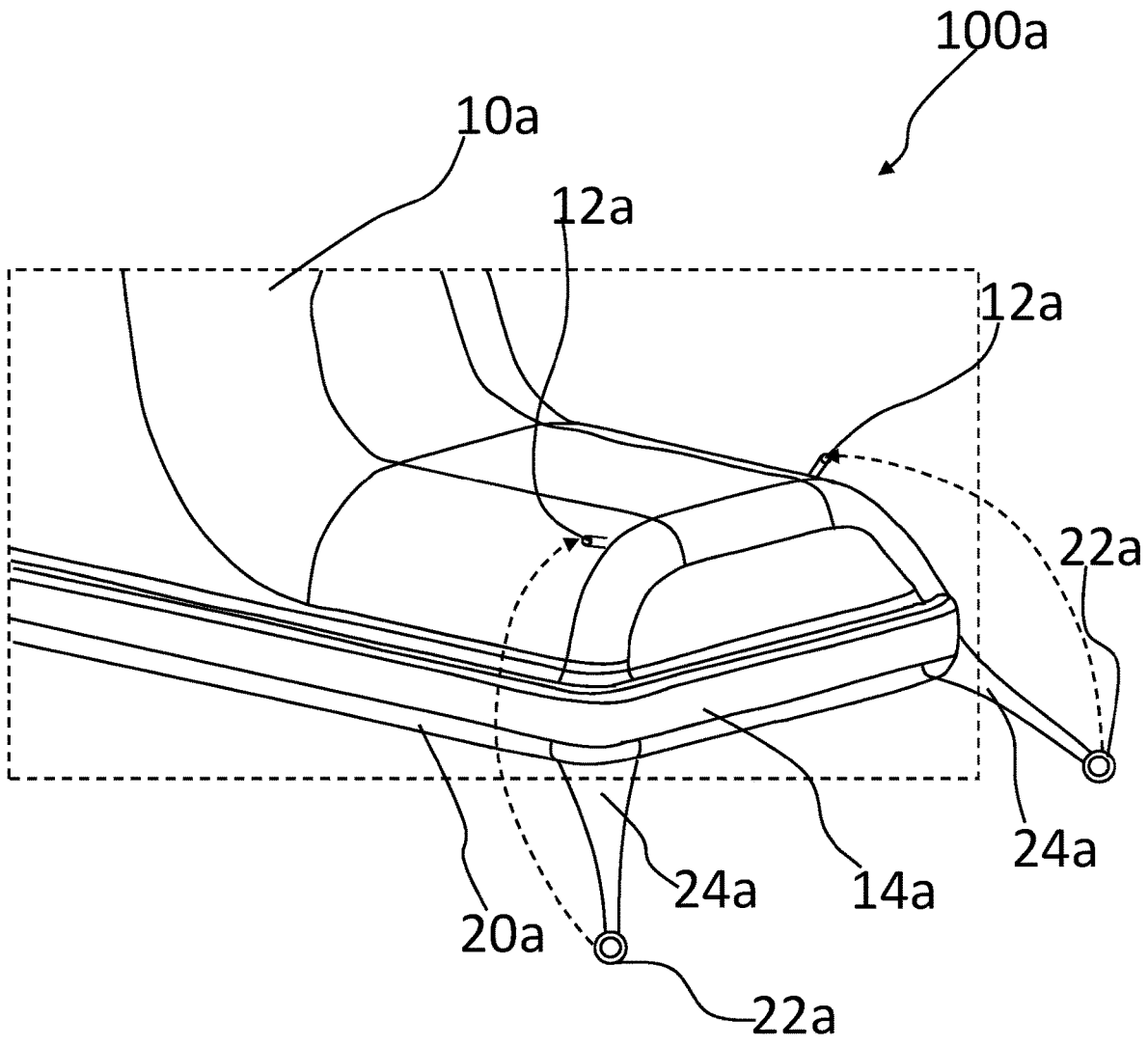
Figure 2C:
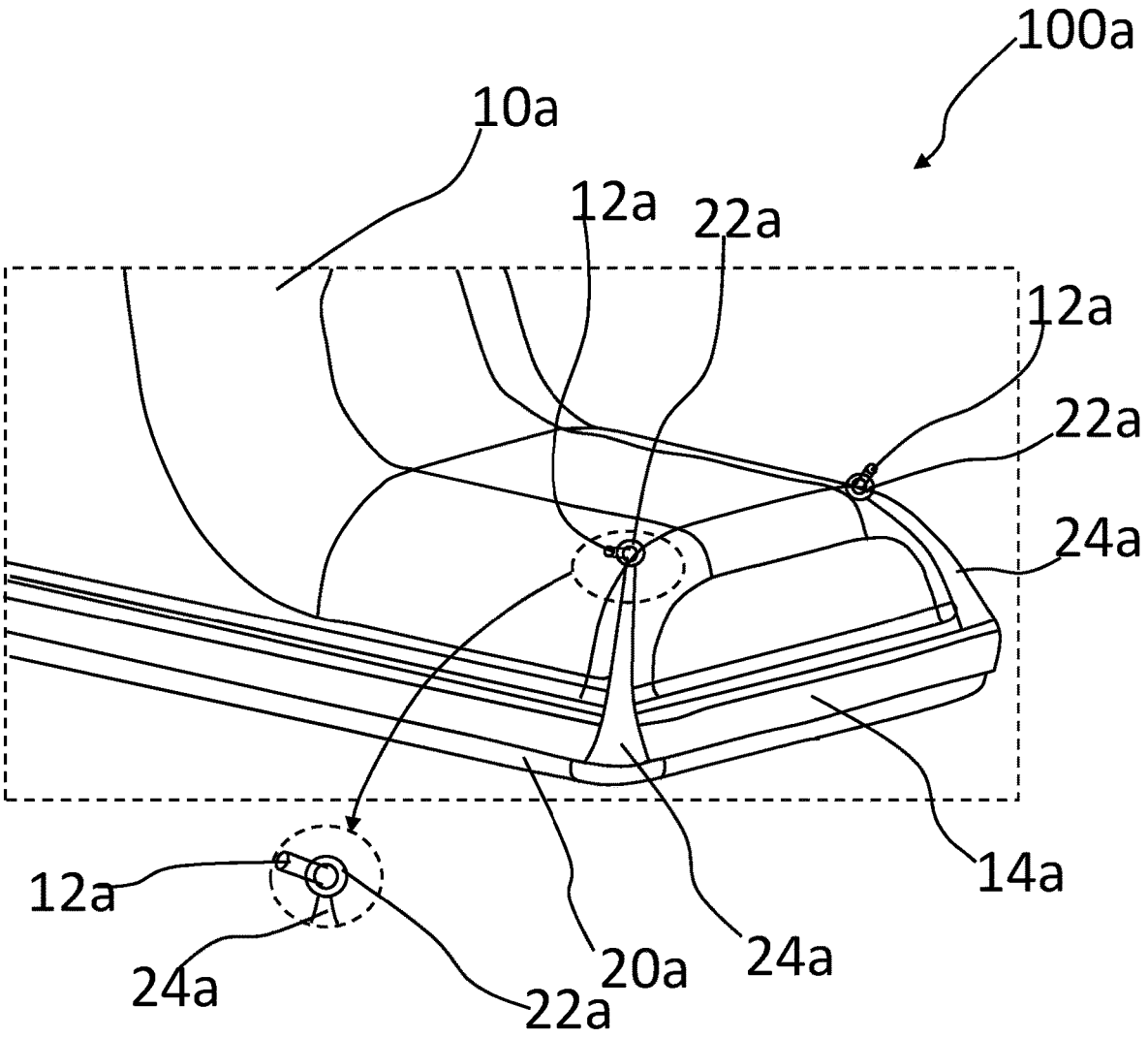
Figure 3:
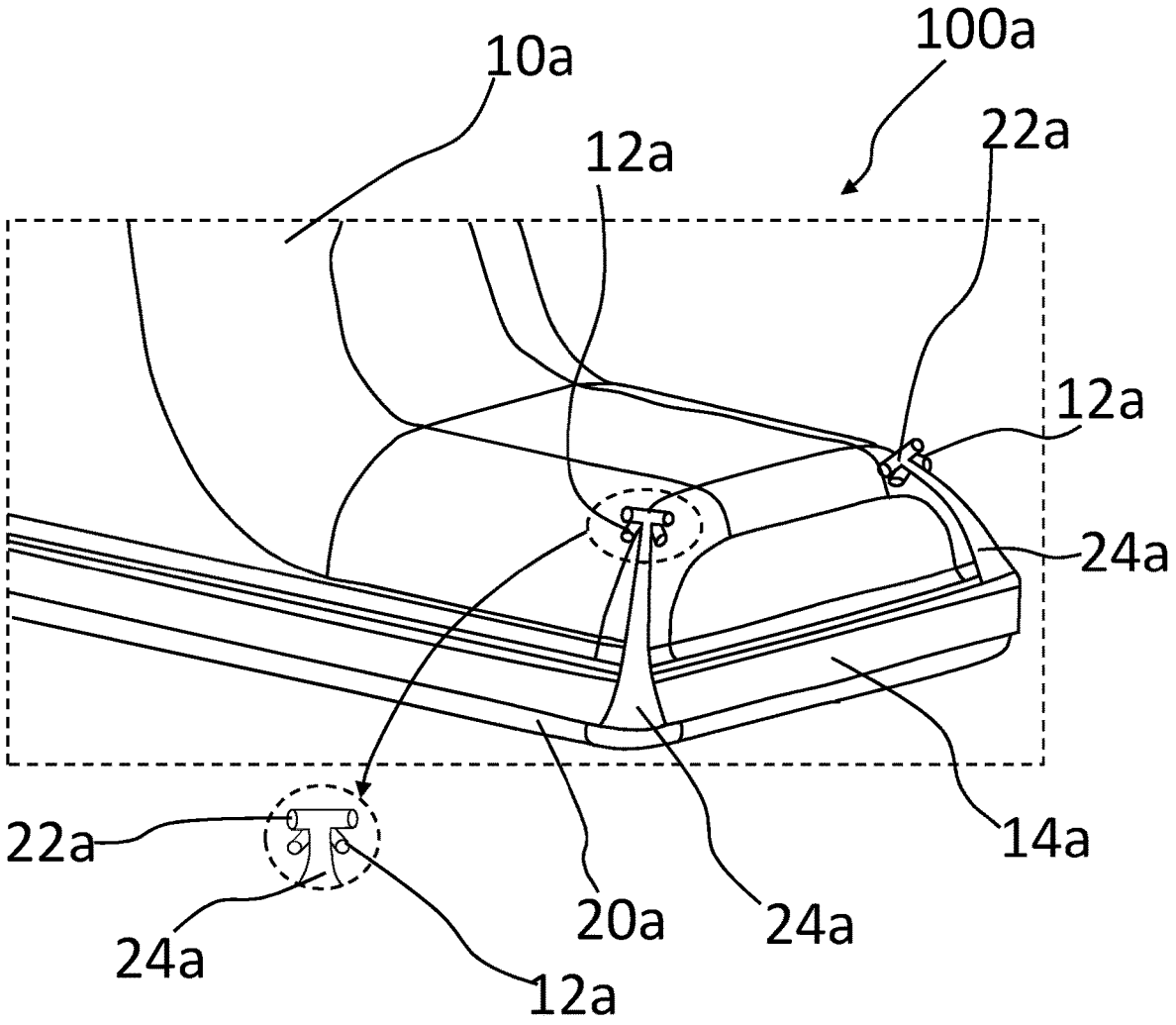
Figure 4:
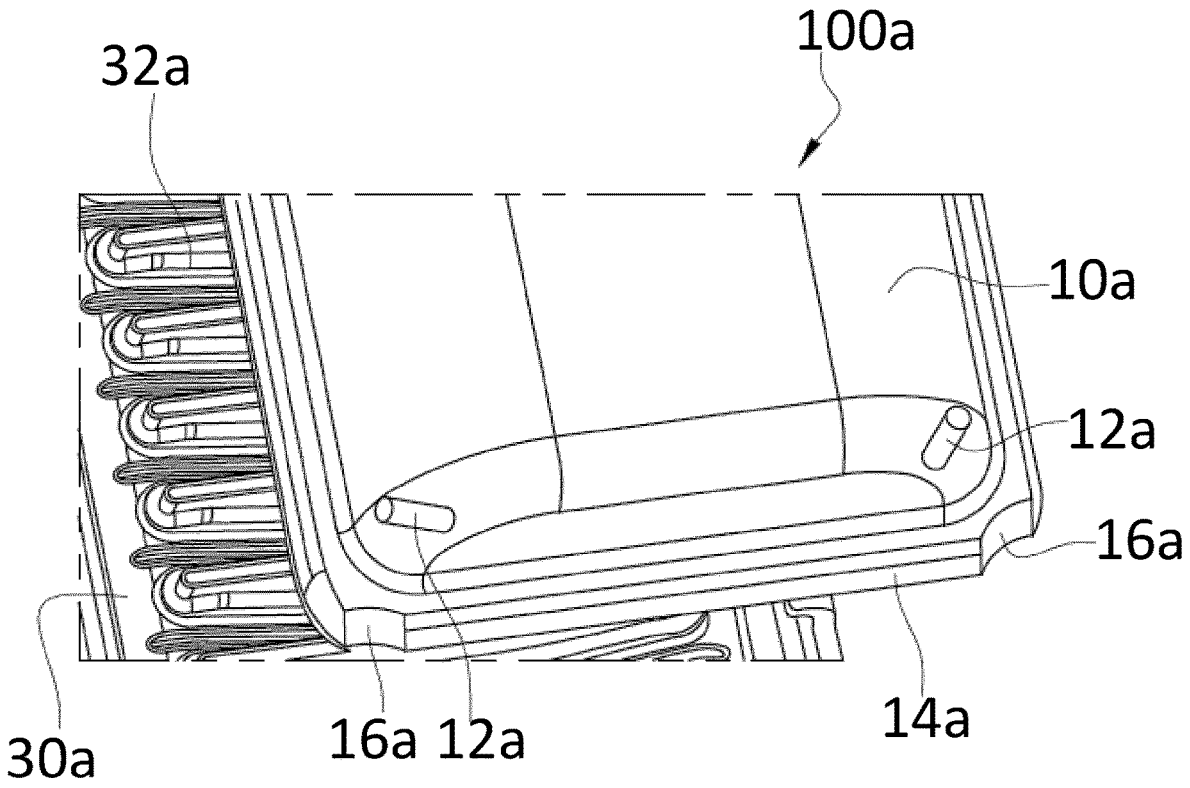

FIG. 2*a* illustrates a schematic representation of a header-tank assembly in accordance with an embodiment of the present invention;

FIG. 2*b* illustrates a schematic representation of a header-tank assembly in accordance with another embodiment of the present invention, wherein connection elements with second engagement elements formed thereon are configured at corners of a gasket;

FIG. 2*c* illustrates the schematic representation of the header-tank assembly of FIG. 2*b*, wherein the second engagement elements are depicted engaging with first engagement elements configured on the tank;

FIG. 3 illustrates a schematic representation of a header-tank assembly, wherein first and second engagement elements in accordance with another embodiment are depicted engaging with each other; and FIG. 4 illustrates a schematic representation of a tank of a header-tank assembly in accordance with still another embodiment of the present invention, wherein corners of the tank are configured with cut-out portions for guiding the connection elements.

It must be noted that the figures disclose the invention in a detailed enough way to be implemented, said figures helping to better define the invention if needs be. The invention should however not be limited to the embodiment disclosed in the description.

A header-tank assembly and an assembly process for configuring an airtight connection between a tank and a corresponding header by securely holding a gasket between the tank and the header during crimping or assembly of the tank over the header is disclosed. The header-tank assembly includes a plurality of clamping elements, particularly, connection elements with engagement elements configured thereon. The connection elements are formed on the gasket, particularly at the corners of the gasket. The engagement elements configured on the connection elements are engaged with the complimentary engagement elements configured on the tank to securely mount the gasket in a position. Particularly, engagement between the complimentary engagement elements configured on the tank and the gasket securely mounts the gasket along periphery of a foot portion of the tank, thereby retaining the gasket in the desired position between the foot portion of the tank and the header. Such configuration prevents displacement of the gasket even in presence of displacing and compressive forces exerted on the gasket during the crimping and assembly and also adjusts the gasket according to size of the header and the tank to prevent pinching of the gasket. Although, the header—tank assembly of the present invention is used for configuring sealed connection between the header and the tank of the heat exchanger used in vehicles. However, the present invention is also applicable for any other applications where gaskets are required to configure secure sealed connection between engaging parts and it is required to prevent pinching of the gasket, thereby preventing drawbacks associated with pinching of the gasket.

FIG. 1*a* illustrates a schematic representation of a heat exchanger 01 configured with a conventional header-tank assembly 09*a*, 09*b*. FIG. 1*b* and FIG. 1*c* illustrate the conventional header-tank assembly 09*a*, 09*b*, wherein a gasket 08*a*, 08*b* is disposed between a header 02*a*, 02*b* and a foot portion 07*a*, 07*b* of a corresponding tank 06*a*, 06*b*. In the conventional header-tank assembly 09*a*, 09*b*, the pinching of the gasket 08*a*, 08*b* is common, due to displacement of the gasket 08*a*, 08*b* during crimping of the header 02*a*, 02*b* over the tank 06*a*, 06*b* or selection of inappropriate sized gasket 08*a*, 08*b*. The pinching of the gasket 08*a*, 08*b* may cause damage to the gasket 08*a*, 08*b* and reduce service life and reliability of the gasket 08*a*, 08*b*. Further, leakage of heat exchange fluid through damaged gasket may adversely impact performance and efficiency of the heat exchanger 01.

The present invention envisages a header-tank assembly of a pair of header-tank assemblies 100*a*, 100*b* for a heat exchanger such as for example, a radiator. More specifically, the heat exchanger generally includes a first header-tank assembly and a second header-tank assembly, wherein the first header-tank assembly 100*a* and the second header-tank assembly 100*b* are respectively configured at extreme end portions of a heat exchanger core of the heat exchanger. As the first and the second header-tank assemblies are identical, every embodiment disclosed henceforth for the first header-tank assembly 100*a* and the elements configuring the first header-tank assembly 100*a* may also applicable for the second header-tank assembly 100*b* and elements configuring the header-tank assembly 100*b*. For sake of brevity of present document, enlarged views depicting the details of only the first header-tank assembly 100*a* are illustrated in the Figures and described in the forthcoming description.

As illustrated in FIG. 2*a*-FIG. 4, the header-tank assembly 100*a* includes a tank 10*a*, a gasket 20*a* and a header 30*a* (illustrated in FIG. 4). The tank 10*a* includes a plurality of first engagement elements 12*a* configured thereon. Specifically, the first engagement elements 12*a* are located substantially on opposite sides of the tank 10*a* with respect to the gasket 20*a* and the header 30*a*. More specifically, the first engagement elements 12*a* are located substantially on a side of the tank 10*a* that is adjacent to and orthogonal to a side accommodating the gasket 20*a* and the header 30*a*. The gasket 20*a* includes a plurality of second engagement elements 22*a* configured thereon. The second engagement elements 22*a* are complimentary to and engages with the first engagement elements 12*a* to mount the gasket 20*a* along a periphery of a foot portion 14*a* of the tank 10*a*, thereby retaining the gasket 20*a* in a desired position, particularly between the foot portion 14*a* of the tank 10*a* and the corresponding header 30*a* even during crimping of the header 30*a* over the tank 10*a*. The connection between the first engagement elements 12*a* and the corresponding complimentary second engagement elements 22*a* is releasable engagement. FIG. 2*a* illustrates the header-tank assembly 100*a* depicting the second engagement elements 22*a* configured on the gasket 20*a* directly engaged with the first engagement elements 12*a* configured on the tank of the header tank assembly 100*a*. The header 30*a* is crimped to the foot portion 14*a* of the tank 10*a* with the gasket 20*a* securely held between the foot portion 14*a* of the tank 10*a* and the corresponding header 30*a*. With such configuration, the gasket 20*a* is retained in the desired position between the foot portion 14*a* of the tank 10*a* and the corresponding header 30*a*, irrespective of various displacing and compressive forces acting on the gasket 20*a* during the crimping of the header 30*a* over the foot portion 14*a* of the tank 10*a*. With such configuration, the displacement of the gasket 20*a* and accordingly the pinching of the gasket 20*a* between the tank 10*a* and the header 30*a* is eliminated. As such, the drawbacks associated with the pinching of the gasket 20*a*, such as damage to the gasket 20*a* are eliminated and the service life of the gasket 20*a* is improved. Further, the leakage of heat exchange fluid leaking through damaged gasket 20*a* is eliminated and performance and efficiency of the heat exchanger configured with the header-tank assembly 100*a* of the present invention is not adversely impacted as the pinching of the gasket 20*a* is eliminated.

In accordance with preferred embodiment of the present invention as illustrated in FIG. 2*b*, FIG. 2*c* and FIG. 3, the header-tank assembly 100*a* includes a plurality of connection elements 24*a* that outwardly extend from the gasket 20*a*. Particularly, the connection elements 24*a* are configured at the corners of the gasket 20*a* and each connection element 24*a* includes at least one, second engagement element 22*a* formed thereon. The connection elements 24*a* enable the second engagement elements 22*a* to reach and engage with the first engagement elements 12*a* formed on the tank 10*a* to securely mount the gasket 20*a* along the periphery of the foot portion 14*a* of the tank 10*a*, thereby retaining the gasket 20*a* in the desired position, particularly between the foot portion 14*a* of the tank 10*a* and the corresponding header 30*a*. FIG. 2*b* is a schematic representation of the header-tank assembly 100*a* with the second engagement elements 22*a* formed on the connection elements 24*a* disengaged from the first engagement elements 12*a*. FIG. 2*c* is a schematic representation of the header-tank assembly 100*a* with the second engagement elements 22*a* configured on the connection elements 24*a* engaged with the first engagement elements 12*a* configured on the tank 10. In accordance with an embodiment, at least one of the connection elements 24*a* is having a single-piece construction, else the at least one of the connection elements 24*a* is configured by joining a plurality of elements.

In accordance with an embodiment of the present invention, the second engagement elements 22*a* are formed at extreme ends of the connection elements 24*a*. The connection elements 24*a* and the second engagement elements 22*a* configured thereon are integrally formed with the gasket 20*a* and as such are of the same material as that of the gasket 20*a*. In accordance with an embodiment, the connection elements 24*a* are having cross-sectional dimension less than that of the gasket 20*a*. In accordance with another embodiment of the present invention, the connection elements 24*a* are secured to the gasket 20*a* and are configured of different material than that of the gasket 20*a*. As the connection elements 24*a* are configured at the corners of the gasket 20*a*, the connection elements 24*a* do not interfere with crimping of the header 30*a* over the foot portion 14*a* of the tank 10*a* while configuring connection between the first and the second engagement elements 12*a*, 22*a*. However, the present invention is not limited to any particular configuration and material of the connection elements 24*a*, the number and placement of the connection elements 24*a* as far as the connection elements 24*a* enable the second engagement elements 22*a* to reach and engage with the first engagement elements 12*a* and securely mount the gasket 20*a* in the desired position, without interfering with crimping of the header 30*a* over the foot portion 14*a* of the tank 10*a*. The header 30*a* receives the heat exchange tubes 32*a* in the apertures configured on the header 30*a*. The engagement between the first engagement elements 12*a* and the second engagement elements 22*a* can serve as an arrangement for temporarily positioning the gasket 20*a* in the desired position, particularly, between the foot portion 14*a* of the tank 10*a* and the corresponding header 30*a*, until the header 30*a* is crimped to the corresponding tank 10*a*. In one example, the first engagement elements 12*a* and the second engagement elements 22*a* can be disengaged from each other once the header 30*a* is crimped to the corresponding tank 10*a*. In another example, the connection elements 24*a* can be severed after the header 30*a* is crimped to the corresponding tank 10*a*.

The second engagement elements 22*a* engage with the complimentary first engagement elements 12*a* configured on the tank 12 and securely mounts the gasket 20 in position. Particularly, the engagement between the first engagement elements 12*a* and the complimentary second engagement elements 22*a* configured on the tank 10*a* and the gasket 20*a* respectively, securely mounts the gasket 20*a* along periphery of the foot portion 14*a* of the tank 10*a* in the desired position, particularly, between the foot portion 14*a* of the tank 10*a* and the header 30*a* and retains the gasket 20*a* in the desired position. The first engagement elements 12*a* and the corresponding complimentary second engagement elements 22*a* are selected from a group comprising snap fit engagement elements, loop-rod type engagement elements and the likes. FIG. 3 illustrates a schematic representation of the header-tank assembly 100*a* in accordance with another embodiment, wherein the first engagement elements 12*a* and the second engagement elements 22*a* are having another configuration and are engaging with each other. However, the present invention is not limited to any particular configuration and placement of the first engagement elements 12*a* and the second engagement elements 22*a* as far as the first engagement elements 12*a* and the second engagement elements 22*a* engage with each other to mount the gasket 20*a* in place without interfering with crimping of the header 30*a* over the foot portion 14*a* of the tank 10*a*. In accordance with an embodiment as illustrated in FIG. 2*a*, the first engagement elements 12*a* can be configured close to the foot portion 14*a* of the tank 10*a* or on the foot portion 14*a* of the tank 10*a* and the second engagement elements 22*a* configured on the gasket 20*a* directly engages with the first engagement elements 12*a*. Alternatively, the first engagement elements 12*a* are configured away from the foot portion 14*a* of the tank 10*a* and the connecting elements 24*a* configured at the corners of the gasket 20*a* enables engagement between the second engagement elements 22*a* formed at the free ends of the connecting elements 24*a* and the first engagement elements 12*a* configured away from the foot portion 14*a* of the tank 10*a* as illustrated in FIG. 2*c*.

The tank 10*a* further includes cut-out portions 16*a* configured at corners thereof for guiding the connection elements 24*a* such that the second engagement elements 22*a* configured on the connection element 24*a* are guided to reach the first engagement elements 12*a*. FIG. 4 illustrates a schematic representation of the tank 10*a* of the header-tank assembly 100*a*, wherein corners of the tank 10*a* are configured with the cut-out portions 16*a* for guiding the connection elements 24*a* configured at the corners of the gasket 10*a* so as to configure engagement between the second engagement elements 22*a* configured on the connection elements 24*a* and the first engagement element 12*a*.

In accordance with an embodiment of the present invention, the gasket 20*a* as well as the connection elements 24*a* may stretch as the first engagement elements 12*a* and the second engagement elements 22*a* engage with each other. Such configuration not only securely mounts the gasket 20*a* over the foot portion 14*a* of the tank 10*a* at the desired position and prevents displacement of the gasket 20*a* from the desired position but also adjusts the gasket 20*a* according to size of the header 30*a* and the tank 10*a*, thereby preventing pinching of the gasket 20*a* caused due to selection of inappropriate size of the gasket 20*a*. In one embodiment, the gasket 20*a* can be pre-assembled over the foot portion 14*a* of the tank 10*a*, and such pre-assembled tank and gasket assembly with the gasket 20*a* held in position is mounted over the header 30*a* by crimping operation. With such configuration, the step of aligning the gasket 20*a* with respect to the tank 10*a* and the header 30*a* is eliminated, accordingly, the assembly time is reduced and assembly is convenient.

A heat exchanger tank 10*a* is disclosed in accordance with an embodiment of the present invention. The heat exchanger tank 10*a* includes a plurality of first engagement elements 12*a* that engages with a plurality of second engagement elements 22*a* configured on a gasket 20*a* to mount the gasket 20*a* in place, particularly, along a periphery of a foot portion 14*a* of the heat exchanger tank 10*a* to retain the gasket 20*a* between the foot portion 14*a* of the heat exchanger tank 10*a* and the corresponding header 30*a*.

Several modifications and improvement might be applied by the person skilled in the art to the header-tank assembly 100*a*, 100*b* as defined above, and such modifications and improvements will still be considered within the scope and ambit of the present invention, as long as it comprises a tank, a gasket and a header. The tank includes a plurality of first engagement elements configured thereon. The gasket includes a plurality of second engagement elements configured thereon. The second engagement elements are complimentary to and engages with the first engagement elements to mount the gasket along a periphery of a foot portion of the tank. The header is crimped to the foot portion of the tank with the gasket disposed between the header and the foot portion of the tank.

Obviously, numerous modifications and variations of the present invention are possible in light of the above teachings. It is therefore to be understood that the invention may be practiced otherwise than as specifically described herein.

In any case, the invention cannot and should not be limited to the embodiments specifically described in this document, as other embodiments might exist. The invention shall spread to any equivalent means and any technically operating combination of means.

The invention claimed is:

1. A header-tank assembly comprising:

a tank comprising a plurality of first engagement elements configured thereon, wherein the first engagement elements are protruding elements;

a gasket comprising a plurality second engagement elements configured thereon, wherein the second engagement elements are configured to engage with the first engagement elements, wherein the second engagement elements are formed on connection elements outwardly extending from the gasket, wherein engagements of the second engagement elements with the first engagement elements are configured to mount the gasket along a periphery of a foot portion of the tank, wherein connection between the first engagement elements and corresponding complimentary second engagement elements is releasable engagement; and a header configured to be crimped to the foot portion of the tank, wherein the connection elements are configured at corners of the gasket and do not interfere with crimping of the header over the foot portion of the tank, while configuring connection between the first and the second engagement elements, and wherein the gasket is configured to be securely held between the header and the foot portion of the tank.

2. The header-tank assembly as claimed in claim 1, wherein the connection elements and the second engagement elements formed thereon are integrally formed with the gasket and are configured of same material as that of the gasket.

3. The header-tank assembly as claimed in claim 1, wherein the connection elements are having cross-sectional dimension less than that of the gasket.

4. The header-tank assembly of claim 1, wherein the first engagement elements and corresponding complimentary second engagement elements are selected from a group comprising snap fit engagement elements, loop-rod type engagement elements and any combination thereof.

5. The header-tank assembly as claimed in claim 1, wherein the tank further comprises cut-out portions configured at corners thereof for guiding the connection elements such that the second engagement elements configured on the connection element are guided by them to reach the first engagement elements.

6. The header-tank assembly of claim 1, wherein the first engagement elements are located substantially on opposite sides of the tank with respect to the gasket and the header.

7. The header-tank assembly of claim 1, wherein the first engagement elements are located substantially on a side of the tank that is adjacent to and orthogonal to a side accommodating the gasket and the header.

8. The header-tank assembly of claim 1, wherein the second engagement elements are formed at distal ends of the connection elements.

* * * * *